US005177774A

United States Patent [19]

Suckewer et al.

[11] Patent Number: 5,177,774

[45] Date of Patent: Jan. 5, 1993

[54] REFLECTION SOFT X-RAY MICROSCOPE AND METHOD

[75] Inventors: Szymon Suckewer, Princeton; Charles H. Skinner, Lawrenceville; Roy Rosser, Princeton, all of N.J.

[73] Assignee: Trustees of Princeton University, Princeton, N.J.

[21] Appl. No.: 749,277

[22] Filed: Aug. 23, 1991

[51] Int. Cl.[5] ..... G21K 7/00

[52] U.S. Cl. ..... 378/43; 378/84; 378/85

[58] Field of Search ..... 378/43, 74, 84, 85, 378/156, 62

[56] References Cited

U.S. PATENT DOCUMENTS

| | | | |
|---|---|---|---|
| 2,926,258 | 2/1960 | Weissmann | 378/74 |
| 3,702,933 | 11/1972 | Fields et al. | 250/51.5 |
| 3,956,711 | 5/1976 | Waynant | 331/94.5 |
| 4,555,787 | 11/1985 | Cohn et al. | 372/86 |
| 4,704,718 | 11/1987 | Suckewer | 372/5 |
| 4,771,430 | 9/1988 | Suckewer et al. | 372/5 |
| 4,937,832 | 6/1990 | Rocca | 372/5 |
| 4,979,203 | 12/1990 | Suckewer et al. | 378/206 |
| 5,003,567 | 3/1991 | Hawryluk et al. | 378/84 |
| 5,022,064 | 6/1991 | Iketaki | 378/43 |

OTHER PUBLICATIONS

Skinner et al., "Contact Microscopy With A Soft X-ray Laser", *Journal of Microscopy*, vol. 159, Part 1, Jul., 1990, pp. 51 through 60.

Howells et al., "X-ray Microscopes", *Scientific America*, vol. 264, No. 2, Feb., 1991, pp. 88 through 94.

Princeton Plasma Physics Laboratory, *PPPL digest*, "Soft X-ray Laser Developed At Princeton", Mar., 1987, pp. 1-5.

Princeton Plasma Physics Laboratory, *PPPL digest*, "X-ray Laser Microscope Developed At Princeton, Progress Toward Shorter Wavelengths Underway", May, 1989, pp. 1-6.

*Primary Examiner*—David P. Porta

*Attorney, Agent, or Firm*—Watov & Kipnes

[57] ABSTRACT

A reflection soft X-ray microscope is provided by generating soft X-ray beams, condensing the X-ray beams to strike a surface of an object at a predetermined angle, and focusing the X-ray beams reflected from the surface onto a detector, for recording an image of the surface or near surface features of the object under observation.

21 Claims, 6 Drawing Sheets

REFLECTION SOFT X-RAY MICROSCOPE AND METHOD

GOVERNMENT LICENSE RIGHTS

This invention was made with government support under Contract No. DE-AC02-76-CH03073 awarded by the Department of Energy and support from Princeton X-ray Laser Inc. (PXL). The Government has certain rights in this invention.

FIELD OF THE INVENTION

The field of the present invention relates generally to microscopy, and more particularly to X-ray microscopy.

BACKGROUND OF THE INVENTION

The use of X-ray radiation in microscopy is known in the prior art. Such known X-ray microscopes typically are of the transmission mode type microscope, which include the source of X-rays on one side of the specimen or object to be viewed, and a radiation detector or imaging system on the other side of the object. Accordingly, only X-rays going through the material are detected. As a result, the use of such transmission type X-ray microscopes for viewing non-transparent or poorly transparent objects is limited, particularly with respect to soft X-ray lasers.

The technology related to X-ray microscopy has been greatly improved over the last ten years. Significant progress has been made in developing X-ray lasers, and synchrotron insertion devices, for providing increased brightness of laboratory X-ray sources.

Optical microscopy is limited to a resolution of about 3,000 angstroms, or about 0.3 micrometer. In lithographic systems used for inspecting integrated circuits, the capability for inspecting line widths of such circuits of less than 0.1 micrometers and below is now required. Electron microscopes can provide such resolution, but electron microscopes are slow to use for such inspection, and the electron beam can cause functional damage to the integrated circuit chip.

Skinner et al., in a paper entitled "Contact Microscopy With A Soft X-ray Laser", appearing in the *Journal of Microscopy,* Volume 159, part I, July, 1990, on pages 51 through 60, discusses the use of soft X-ray lasers for imaging live cells at high resolution, "thereby bridging the gap between electron microscope images of non-live cells that have undergone extensive specimen preparation, and low resolution but high fidelity images of live cells recorded with light microscopes." It is recognized that "to be of maximum utility to biologists, a soft X-ray laser contact microscope should be suitable for everyday use on fragile, living biological specimens." The paper also describes a system developed at Princeton University, Princeton, N.J., for generating soft X-ray laser beams. The installation of a contact microscope on a soft X-ray laser beam is shown. In this system, the soft X-ray laser beam is used to cause the shadow of a specimen to be recorded on photo-resist material.

Howells, et al., in a paper entitled "X-ray Microscopes", *Scientific American,* Volume 264, No. 2, February, 1991, pages 88 through 94, describes the state of X-ray microscopy, and the ongoing development of "soft" X-ray instruments, providing more than ten times better resolution than optical microscopes. It is indicated that "soft X-rays in the wavelength range of 20.0 to 40.0 angstroms (an angstrom is one ten-billionth of a meter), are sufficiently penetrating to image biological cells in many cases." The article goes on to describe the difficulty of focusing X-ray images and developments which led to the construction of a Fresnel zone plate for providing such focusing. Contact microradiography is described, as previously mentioned above, whereby an X-ray beam is passed through a sample to a resist (PMMA) material, causing a damage pattern in the resist material relating to details of the sample. Imaging X-ray microscopes are described whereby X-ray beams are passed through a condenser zone plate, for focusing the X-rays onto a region of a sample. The X-rays pass through the sample onto a micro-zone plate for focusing the X-rays into an image field that is picked up by a detector. A scanning X-ray microscope system is described whereby an X-ray beam is focused and scanned back and forth across a sample, with the scan beam being passed through the sample and detected by an X-ray counter.

A soft X-ray laser contact microscope system is described in Suckewer et al. U.S. Pat. No. 4,979,203. The described system uses an optical contrast microscope for inspecting and aligning a target prior to applying soft X-rays to the target for performing contact X-ray microscopy. An X-ray laser is used for providing the necessary soft X-ray beam.

Fields, et al. U.S. Pat. No. 3,702,933, entitled "Device and Method for Determining X-ray Reflection Efficiency of Optical Surfaces", teaches a method for determining the X-ray reflection efficiency and scattering characteristics of optical surfaces using much harder (shorter wavelength) X-ray radiation than the soft X-rays described above. As shown in the figure, X-rays of a known wavelength are generated by an X-ray source 11, and passed through a collimator 15, and therefrom passed through slits 17, for projection onto an area of a crystal monochromator 21 for diffracting the X-rays. The diffracted x-rays are then passed through slits 25, and projected onto a predetermined area of an optical test specimen 41. X-rays reflected off of the optical test specimen 27, are transmitted through a slit 33, and projected therefrom into an X-ray detector 31. The X-ray detector can be a Geiger-Muller counter. The intensity of the X-rays prior to and subsequent to reflection from the specimen 27 are compared for determining the efficiency of reflection of the optical surface of the test specimen 27. Suckewer et al. U.S. Pat. No. 4,771,430 shows an apparatus for enhancing soft X-ray lasing action through use of thin blade radiators in a target. Soft X-ray lasing action is generated in a defined plasma column. The plasma is produced by focusing a $CO_2$ laser beam onto a carbon target. A magnetic field is used to compress the plasma into a thin column. A carbon disc in combination with carbon blades mounted perpendicular to the surface of the disc provides the target. The $CO_2$ laser beam is directed to strike the surface of the disc for forming a plasma column. The column is cooled by radiation losses and heat conduction to the blade. The resulting soft X-rays are transmitted through a slot in the carbon disc.

Rocca U.S. Pat. No. 4,937,832 shows a method and apparatus for producing a soft X-ray laser beam in a capillary discharge plasma. As shown in FIGS. 1 and 2 thereof, the apparatus includes a pair of electrodes having axially oriented poles, respectively, for facilitating the exit of laser radiation. The electrodes are connected to a discharge circuit that includes a relatively large capacitor that is first charged to a given level, and then discharged across the electrodes. It is indicated that the power source can also be an electrical transmission line having a low impedance. Also discussed is the use of a high intensity magnetic field for containing the plasma.

Another Suckewer U.S. Pat. No. 4,704,718, similar to the above-described Suckewer patent, teaches the creation of a plasma column by focusing a $CO_2$ laser pulse on a carbon target. A magnetic field is used to contain the plasma.

There are many other examples of soft X-ray generators and/or ultraviolet X-ray generators in the art. Other such references include U.S. Pat. Nos. 4,555,787, and 3,956,711.

Research is ongoing for providing improved sources of optics at short wavelengths, particularly wavelengths in the soft X-ray region from 1.0 nanometer to 30.0 nanometers wavelength. As previously indicated, laser sources and synchrotrons have provided soft X-rays for use in transmission X-ray microscopy. X-ray lasers provide a very high flux of short wavelength photons in very short pulses in single lines, whereas synchrotrons provide continuously tunable radiation. These sources of X-ray radiation tend to complement one another.

The present inventors recognized that by developing a reflection X-ray laser microscope, a step forward can be made in the field of the art for using such an apparatus in the field of lithography for inspecting integrated circuits, for example, and/or in the medical fields for analyzing biological specimens. They further recognized that the reflection coefficient for a number of biological materials is significant and differs substantially at soft X-ray wavelengths. They recognized that with a high flux of radiation from a soft X-ray laser, and through use of high sensitivity CCD (charge coupled device) detectors, a very compact reflection soft X-ray microscope can be provided. The inventors expect that such a microscope will provide magnification up to $\times 100$ with the resulting images recorded on CCD-array detectors, for example, having a pixel size in the order of 5.0 microns. Such a soft X-ray reflecting microscope is expected to have a resolution in the range of 0.05 microns.

It is further expected a soft X-ray laser source for use with the reflection X-ray microscope of the present invention will operate at a wavelengths of 18.2 nanometers (nm) with a beam energy of 1.0 to 3.0 mJ (millijoule) in a 10.0 to 30.0 nanosecond pulse. The laser can operate at shorter wavelengths (15.4 nm and 12.9 nm) with lower beam energy. A pumping $CO_2$ laser pulse with an energy of 300.0 to 500.0 joules in 50.0 to 75.0 nanoseconds will create a lasing medium (plasma column) in a strong, magnetic field. Also, the repetition rate of the X-ray laser is three minutes.

The present inventors are scientists at the Princeton University Plasma Physics Laboratory (PPPL) (Skinner and Suckewer) and Mechanical and Aerospace Engineering Department (Suckewer) and Princeton X-ray Laser Inc. (Rosser), in Princeton, N.J., where soft X-ray laser development has been pursued for a number of years. In the March, 1987, issue of the "PPPL Digest", published by the Information and Administrative Services, Princeton Plasma Physics Laboratory, Princeton, N.J., the basics of soft X-ray technology existing in 1987 and various experimental results are discussed. In a later May, 1989 issue of the "PPPL Digest", a description of X-ray laser microscopy research at that facility is described. A composite X-ray laser microscope is shown and described for soft X-ray laser contact microscopy. Also, the basic principals of a soft X-ray laser are shown and described.

SUMMARY OF THE INVENTION

An object of the invention is to provide a reflecting soft X-ray microscope.

With the problems of the prior art in mind, these and other objects are provided in one embodiment of the invention by positioning a source of soft X-rays (for example, a soft X-ray laser) for directing a soft X-ray beam through focusing means for focusing the beam to strike an object or specimen at a predetermined angle, for illuminating a portion of the specimen, a portion of the beam reflected off of the object o specimen is passed into imaging means for focusing the reflected beam, for forming an image for detection by a CCD (charge coupled device) array or X-ray sensitive film, for example.

BRIEF DESCRIPTION OF THE DRAWINGS

Various embodiments of the present invention are illustrated herein with reference to the drawings, which are not to scale, in which like items are identified by the same reference designation, wherein.

DETAILED DESCRIPTION OF THE INVENTION

As previously indicated, the present invention is intended for use in the microscopy of biological elements and observation of very fine details of semiconductor elements, for example. However, its use is not meant to be so limited, and many other uses will occur to those of skill in the art. Various embodiments of the present invention are described below, all of which may be used in constructing commercial reflection soft X-ray microscopes. It is expected that such a refection soft X-ray microscope will permit the observation of surfaces of materials and thin (1–10 nm) layers near the surfaces with ten times higher resolution than that presently available from optical microscopes.

The basis of the present invention is that reflection coefficients for soft X-ray radiation (around 10.0 to 20.0 nm) can be substantial, and significantly different for different materials. As described below, in the present reflection soft X-ray microscope, the source of soft X-ray radiation, and the detector or imaging system for the X-rays are on the same side of the specimen or object under observation. The detector or imaging system records only soft X-rays reflected from the surface or layers near the surface of the specimen or object under observation.

Figure 1:
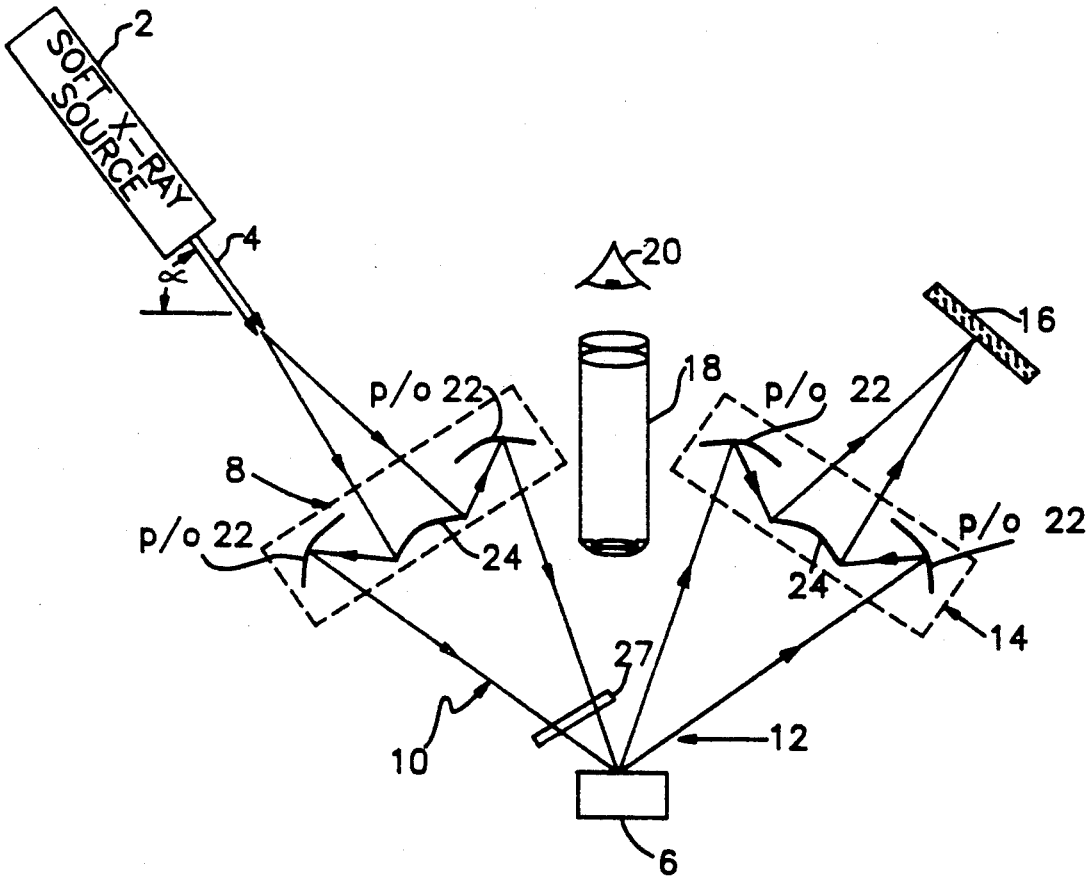
FIG. 1 shows a block schematic view of one embodiment of the invention using multi-layer coated Schwarzschild mirrors on both the condenser and imaging sides of an object.

In the preferred embodiment of the invention, as shown in FIG. 1, a soft X-ray generator 2, in this example a soft X-ray laser source 2 is shown, provides a soft X-ray beam 4 at an angle $\alpha$ of 30° to 60° to the horizontal plane of an object or specimen 6, for example. A Schwarzschild mirror condenser 8 is located between the source of soft X-rays 2 and the object or specimen 6 for focusing the soft X-ray beam 4 onto a predetermined region on the surface of the object 6, as shown. The condensed soft X-ray beams 10 illuminate a region under observation on object 6 and reflect off of this region as shown by the reflected soft X-ray beams 12. A Schwarzschild mirror objective 14 is placed at an appropriate angle to the normal and located for receiving the reflected soft X-ray beam 12, and focusing the same onto a detector 16 such as a CCD (charge coupled device) array or photographic film sensitive to soft X-ray beams, for forming an image. As would be known to one of skill in the art, the use of a CCD array for the detector 16 could provide electrical signals to a television system, for example, for permitting a television image to be produced of the region of the surface of the object 6 under observation. An optical microscope 18 is shown for permitting a user represented by eye 20 to visually align the object 6 for permitting observation of a desired region of the object. In certain applications, a bandpass filter 27 can be added between condenser 8 and object 6 for passing the soft X-ray beam 10 while substantially blocking other radiation (see below description for FIG. 5 for details of the filter).

The Schwarzschild condenser 8 and objective 14, as tested in a laboratory configuration, are easy to match in that they have a common f or numerical aperture. Also, Schwarzschild mirrors are commercially available. Spatial resolutions of 0.2 to 0.5 micrometers have been demonstrated in a laboratory for such mirrors.

In one experimental configuration for the present reflection soft X-ray microscope, Schwarzschild Optics manufactured by T. R. Optics, Ltd., of England, were used. The surfaces of the optics were highly polished for providing a surface finish of approximately 0.5 nm rms surface roughness. As shown in FIG. 1, the Schwarzschild mirrors 8 and 14 each include a convex mirror 24, and a concave mirror 22, which for the sake of simplicity is shown as two concave reflective surfaces 22. In the experimental system, the diameter of the convex mirror 22 was 66.3 millimeters, and its radius of curvature was 68.5 millimeters for example. The relatively smaller convex mirror had a diameter of 14.5 millimeters with a radius of curvature of 23 millimeters, for example. The Schwarzschild mirror systems 8 and 14 each had a numerical aperture of 0.4, and a focal length of 14.0 millimeters, in this example. The reflective surfaces of the concave mirror 22 and convex mirror 24 of the Schwarzschild configurations each included a multi-layer coating consisting of fifteen layer-pairs of molybdenum and silicon layers, having thicknesses of 3.0 nm and 9.0 nm, respectively.

Figure 2:
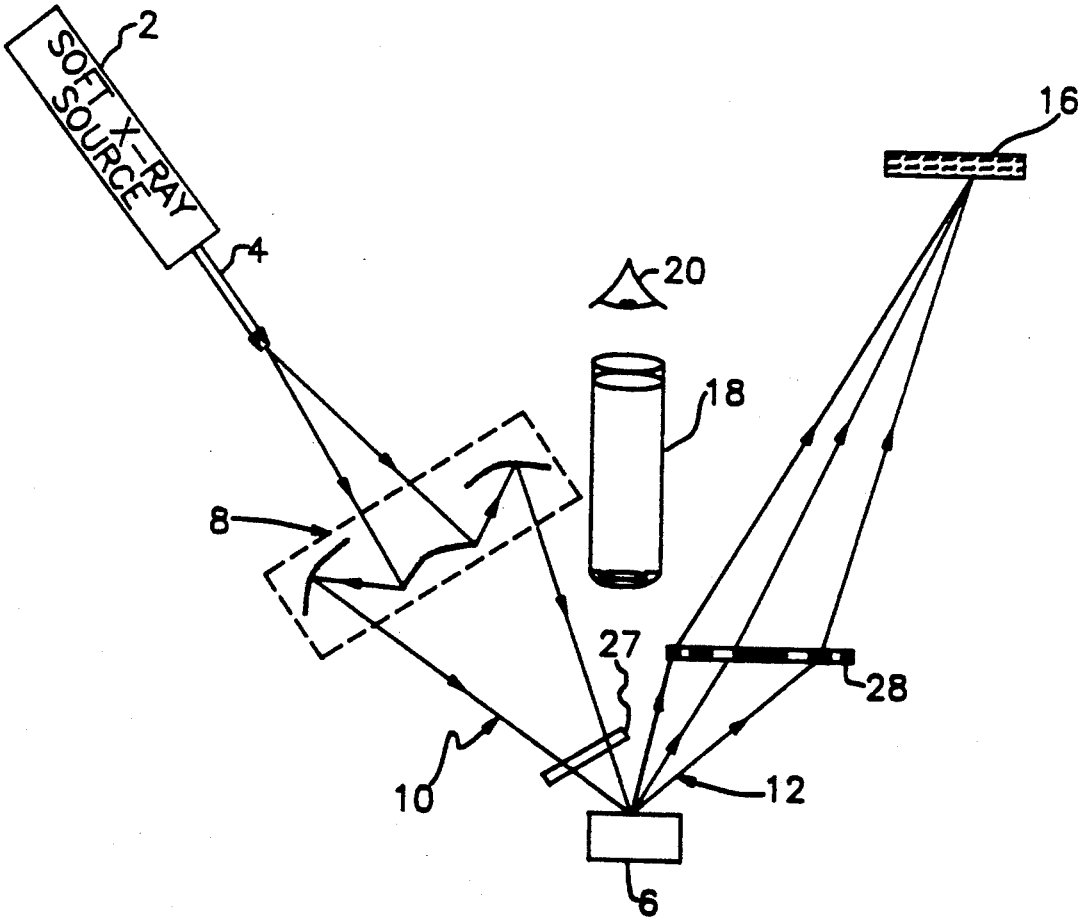
FIG. 2 shows a block schematic diagram of a second embodiment of the invention including a Schwarzschild mirror condenser, and an elliptical zone plate on the imaging side.

In the embodiment of the invention of FIG. 2, the Schwarzschild objective 14 is replace by an elliptical zone plate 28. With present technology, this embodiment of the invention is less preferred in that the elliptical zone plate is not commercially available and is presently a laboratory type device. Nonetheless, it is expected that the elliptical zone plate 28 will provide an effective objective for focusing the reflected soft X-ray laser beams 12 onto the detector 16, for providing good image resolution.

Figure 3:
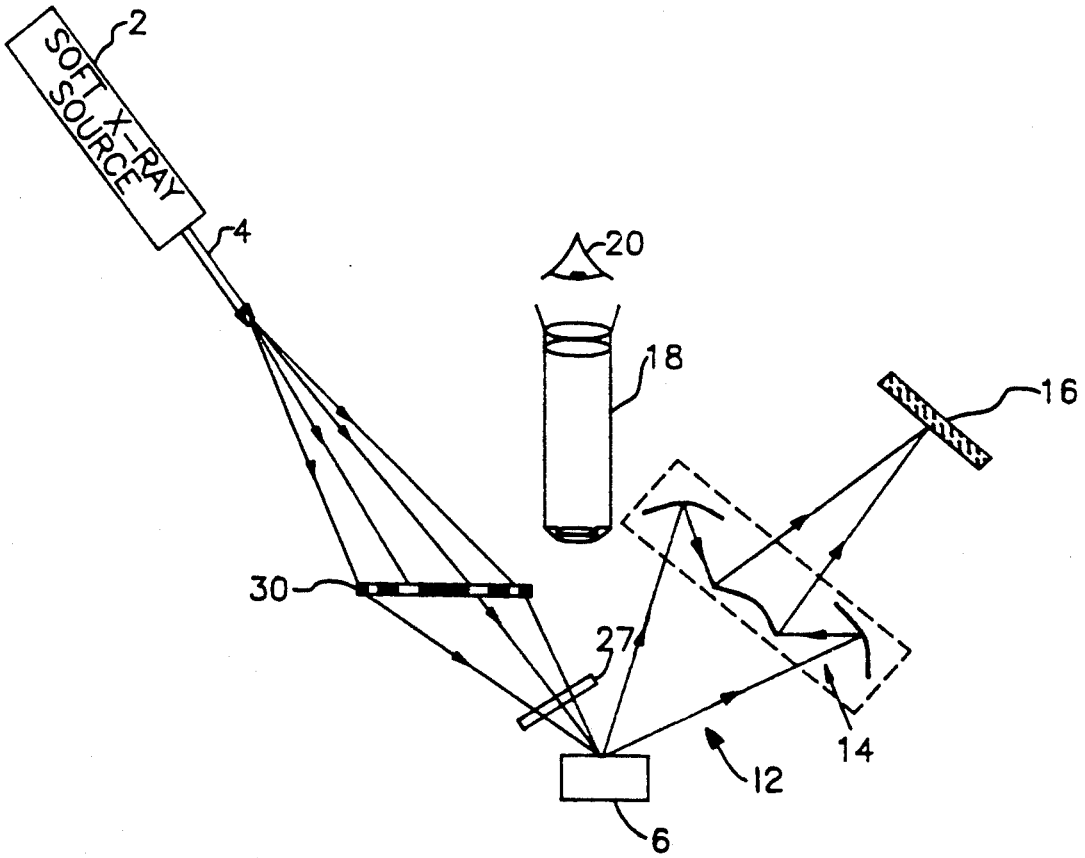
FIG. 3 shows a block schematic diagram of a third embodiment of the invention including an elliptical zone plate condenser, and a Schwarzschild mirror on the imaging side.

In FIG. 3, a third embodiment of the invention includes an elliptical zone plate 30, and a Schwarzschild objective 14 as shown. As previously indicated, the elliptical zone plate 30 is a specialty item not commercially available at the present time. However, it is expected that the elliptical zone plate 30 will provide adequate condensing of the soft X-ray beam 4 for illuminating a predetermined region on the surface of the object 6.

Figure 4:
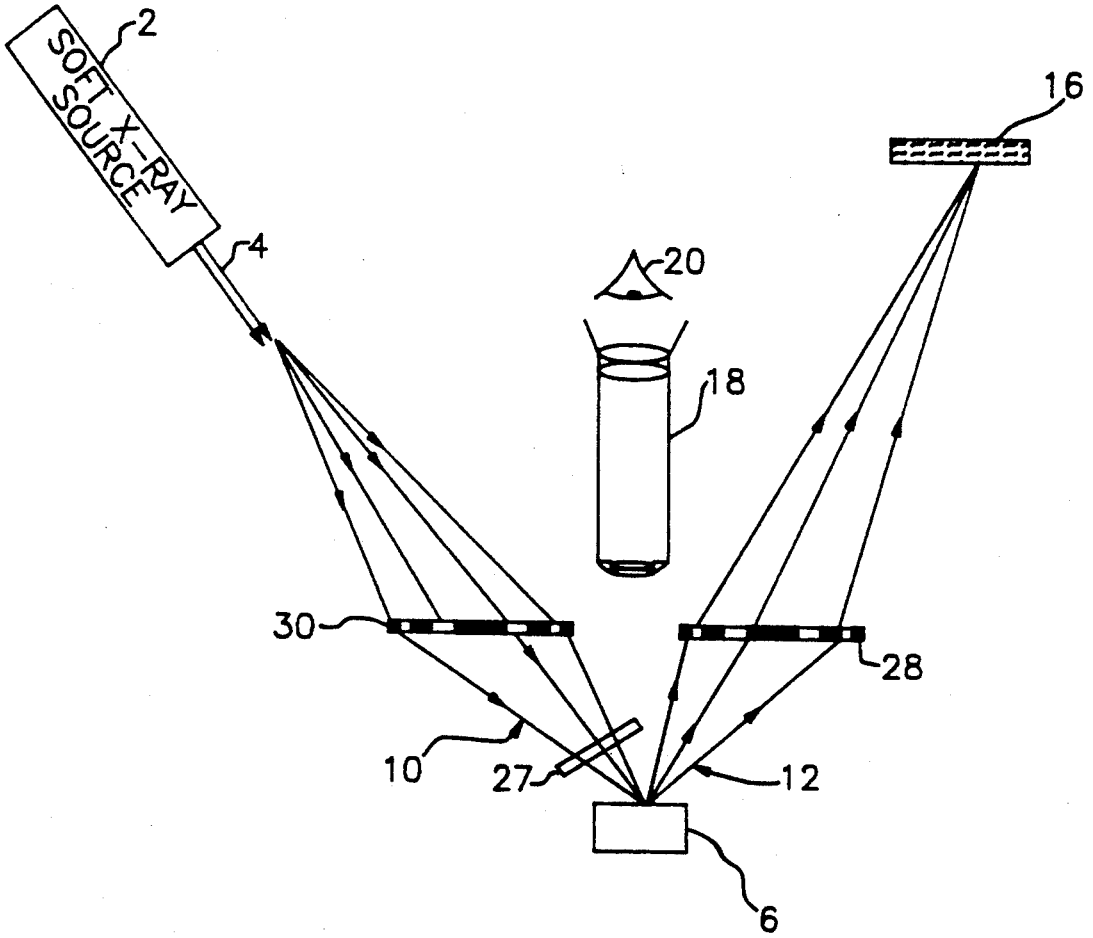
FIG. 4 is a block schematic diagram of a fourth embodiment of the invention including elliptical zone plates on both the condenser and imaging sides of the reflecting microscope.

Another embodiment of the invention is shown in FIG. 4. In this embodiment elliptical zone plates are included for providing both the objective and condenser elements 28, 30, respectively.

Figure 5:
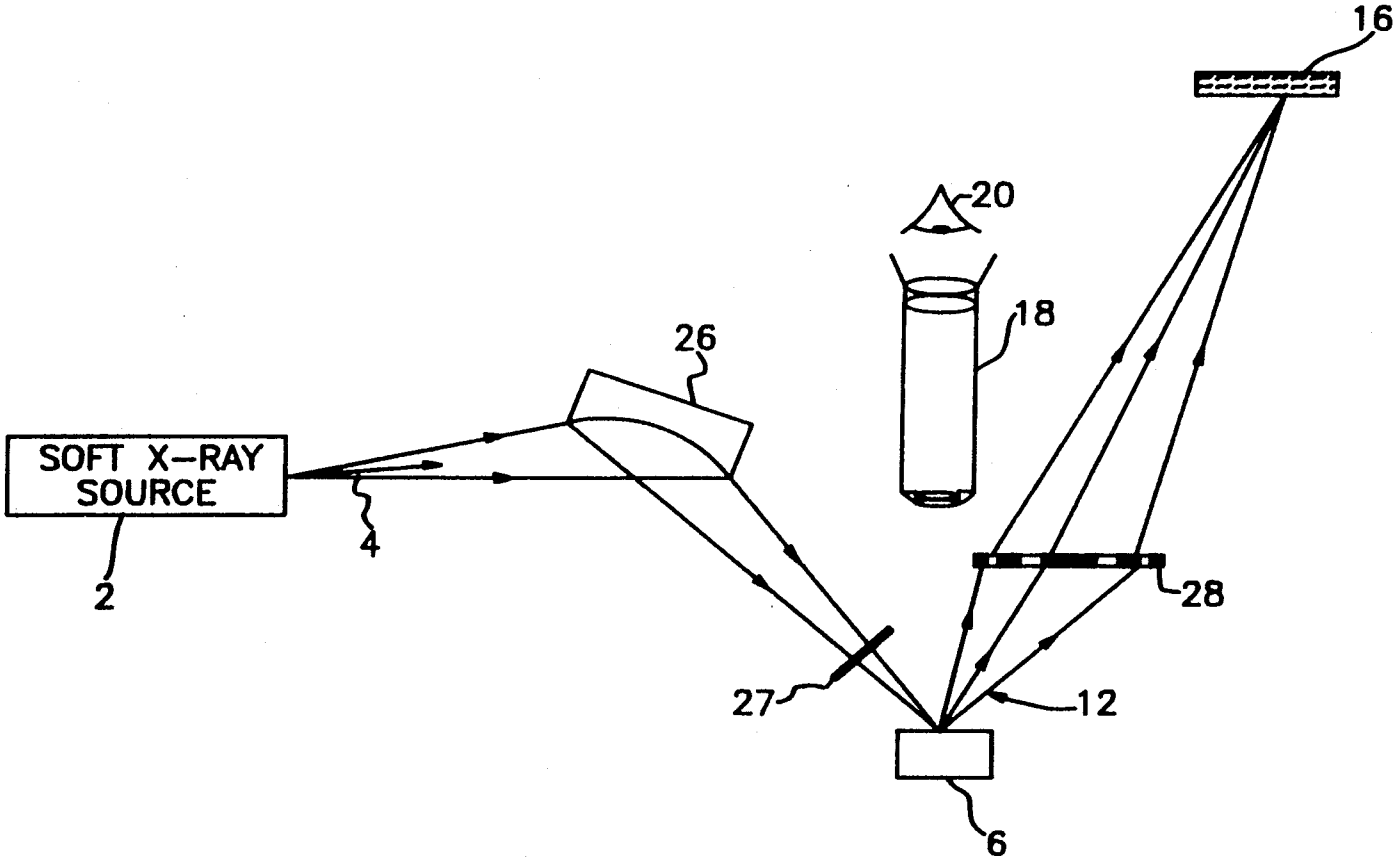
FIG. 5 shows a block schematic diagram of a fifth embodiment of the invention including an ellipsoidal mirror for a condenser, and an elliptical zone plate on the imaging side.

In FIG. 5, another embodiment of the invention includes an elliptical zone plate objective 28, and an ellipsoidal mirror 26, as shown. A filter 27, in this example an 80 nm thick aluminum filter with a coating of 10.0 nm of carbon film, is used in the soft X-ray laser beam path between mirror 26 and object 6 for blocking out VUV (vacuum ultraviolet), UV (ultraviolet) and visible light. In this example, an 18.2 nm soft X-ray laser beam was utilized, whereby the filter 27 had a transmission of about 56.0% at 18.2 nm. Accordingly, filter 27 acts as a bandpass filter for passing the soft X-ray laser beam, while blocking other radiation. If another type of laser source 2 was used having a wavelength other 18.2 nm, filter 27 would be adjusted for maximizing the transmission of the soft X-ray beam.

Figure 6:
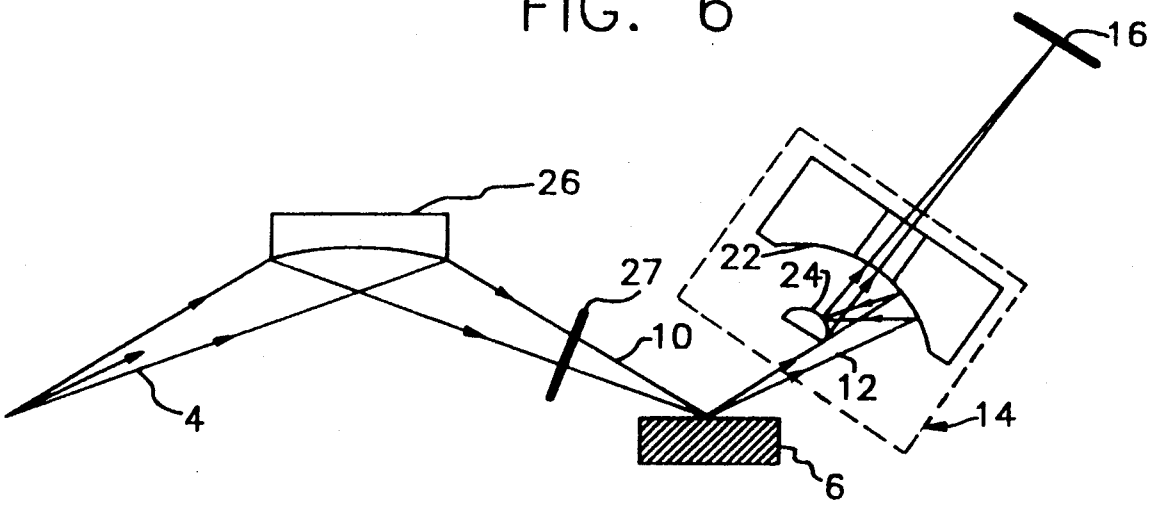
FIG. 6 is a block schematic diagram showing a sixth embodiment of the invention including an ellipsoidal mirror condenser, and a Schwarzschild objective.

In the configuration or embodiment of the invention shown in FIG. 6, the soft X-ray reflection microscope configuration includes an ellipsoidal mirror condenser 26, and a Schwarzschild objective 14, as shown. In this example, an 18.2 nm laser beam was aligned to a reflection object 6 via an ellipsoidal mirror 26. The reflection object 6 was constructed by evaporating gold onto a polished surface through a TEM number 200 grid. The angle of incidence of the 18.2 nm laser beam to the reflection object was limited by the vacuum chamber utilized to 70°, or an angle of 20° between the reflection surface of object 6 and the incident beam 10. The image of the reflection object or grid on the surface of object 6 was recorded in this example on Kodak 101-07 X-ray film providing the detector 16. This configuration verified the operation of the Schwarzschild optics 14, in this example, using an 18.2 nm laser beam 4. A filter 27 is used as indicated above for this embodiment of FIG. 5.

In the embodiments of the invention shown in FIGS. 5 and 6, each embodiment includes ellipsoidal mirror 26 for a condenser. Such a mirror has a small numerical aperture or a high f number. Note also that one would normally not use an ellipsoidal mirror on the imaging side, that is as an objective focusing means, due to the poor resolution of such mirrors resulting from their high f, and the present poor quality of optics available for such mirrors.

Although various embodiments of the invention have been shown and described herein, they are not meant to be limiting. Different modifications may occur to those of skill in the art relative to the embodiments described herein, which modifications are meant to be covered by the spirit and scope of the claims appended hereto. For example, while the elliptical zone plates 28 and 30 in the embodiments of FIGS. 2 through 5 are described in the preferred, embodiment as being elliptical zone plates 28 and 30 can also each be circular zone plates. Also, future cavity based X-ray lasers may be sufficiently collimated so as to permit the elimination of condenser elements 8, 30 and 26 of FIGS. 1–6.

What is claimed is:

1. A soft X-ray reflection imaging microscope for observing surface or near surface features of an object or specimen comprising:

a soft X-ray generator for producing soft X-ray beams;

condenser means for receiving said soft X-ray beams, and focusing said beams to strike an area of the surface of said object at a predetermined angle, thereby causing a portion of said beams to reflect off of the surface of said object at substantially said predetermined angle;

objective means located for receiving said reflected beams and focusing the same to form an image; and detector means for detecting the image formed by said objective means.

2. The X-ray microscope of claim 1, wherein said condenser means and said objective means each include a Schwarzschild mirror.

3. The X-ray microscope of claim 1, wherein said condenser means includes a Schwarzschild mirror, and said objective means includes a zone plate.

4. The X-ray microscope of claim 1, wherein said condenser means includes a zone plate, and said objective means includes a Schwarzschild mirror.

5. The X-ray microscope of claim 1, wherein said condenser means includes a zone plate, and said objective means includes a zone plate, and wherein either of zone plates are circular or elliptical.

6. The X-ray microscope of claim 1, wherein said condenser means includes an ellipsoidal mirror, and said objective means includes a zone plate.

7. The X-ray microscope of claim 1, wherein said condenser means includes an ellipsoidal mirror, and said objective means includes a Schwarzschild mirror.

8. The X-ray microscope of claim 1, further including bandpass filter means located between said condenser means and said object for passing said soft X-ray beams while substantially blocking other radiation.

9. The X-ray microscope of claim 1, further including optical microscope means located for permitting visual alignment of said object relative to said condenser and focusing means.

10. The X-ray microscope of claim 8, wherein said bandpass filter means includes an 80.0 nm thick aluminum filter with a coating of 10.0 nm carbon film.

11. The X-ray microscope of claim 1, wherein said detector means includes a CCD array.

12. The X-ray microscope of claim 1, wherein said detector means includes X-ray sensitive film.

13. A method for providing a soft X-ray reflection imaging microscope, for examining specimens, said method comprising the steps of:

directing soft X-ray beams to strike a surface of a specimen at a predetermined angle thereto for causing said X-ray beams to be reflected off of said surface of said specimen at said predetermined angle; and focusing on a detector a portion of the reflected soft X-ray beams to form an image of the region of the surface or near surface of said specimen struck by said X-ray beams.

14. The method of claim 13, further including the step of recording the image from said focusing step on said detector consisting of photographic film sensitive to said X-rays.

15. The method of claim 13, wherein said focusing step further includes the step of focusing said image on said detector consisting of a CCD array.

16. A soft X-ray reflection imaging microscope for observing surface or near surface features of an object or specimen comprising:

means for generating soft X-ray beams of a predetermined wavelength;

a Schwarzschild mirror condenser, for condensing said soft X-ray beams to illuminate a given area of said specimen;

a Schwartzchild mirror objective, for focusing soft X-ray beams reflected off of the surface of said specimen to form an image; and detector means positioned relative to said focusing means for receiving, for recording, or for visual presentation of the image formed by said focusing means.

17. The X-ray microscope of claim 16, further including bandpass filter means located between said soft X-ray generator and said object for passing said soft X-ray beams while substantially blocking other radiation.

18. The X-ray microscope of claim 16, further including optical microscope means located for permitting visual alignment of said object relative to said directing and focusing means.

19. The X-ray microscope of claim 17, wherein said bandpass filter means includes an 80.0 nm thick aluminum filter with a coating of 10.0 nm carbon film.

20. The X-ray microscope of claim 16, wherein said detector means includes a CCD array.

21. The X-ray microscope of claim 16, wherein said detector means includes X-ray sensitive film.

* * * * *